United States Patent [19]

Pilcher, II

[11] Patent Number: 4,936,190

[45] Date of Patent: Jun. 26, 1990

[54] ELECTROOPTICAL MUZZLE SIGHT

[75] Inventor: James O. Pilcher, II, Bel Air, Md.

[73] Assignee: The United States of America as represented by the Secretary of The Army, Washington, D.C.

[21] Appl. No.: 409,901

[22] Filed: Sep. 20, 1989

[51] Int. Cl.[5] ..... F41G 3/02

[52] U.S. Cl. ..... 89/41.05; 89/41.17

[58] Field of Search ..... 89/41.05, 41.06, 41.17, 89/41.19; 244/3.11, 3.12

[56] References Cited

U.S. PATENT DOCUMENTS 4,570,530 2/1986 Armstrong ..... 89/41.05

OTHER PUBLICATIONS

Application of Mark D. Kregel, S/N06/409,750 filed 08/19/1982, allowed 07/27/84.

*Primary Examiner*—Stephen C. Bentley

*Attorney, Agent, or Firm*—Saul Elbaum; Paul S. Clohan

[57] ABSTRACT

An electrooptical sighting system which provides a sight picture of a target in video display form to the gunner having an electrooptical telescope rigidly fixed to the muzzle end of a gun tube, a fiber-optic transmission link, a sense head for transforming the optical image transmitted from the telescope via the fiber-optic link into a digital voltage signal, a system controller for processing the digital voltage signal. The controller provides an output to a video monitor allowing continuous viewing of the target regardless of framing rate. A means for the multiple coupling of the optics of electronics thereby providing automatic magnification of the picture is also disclosed.

12 Claims, 4 Drawing Sheets

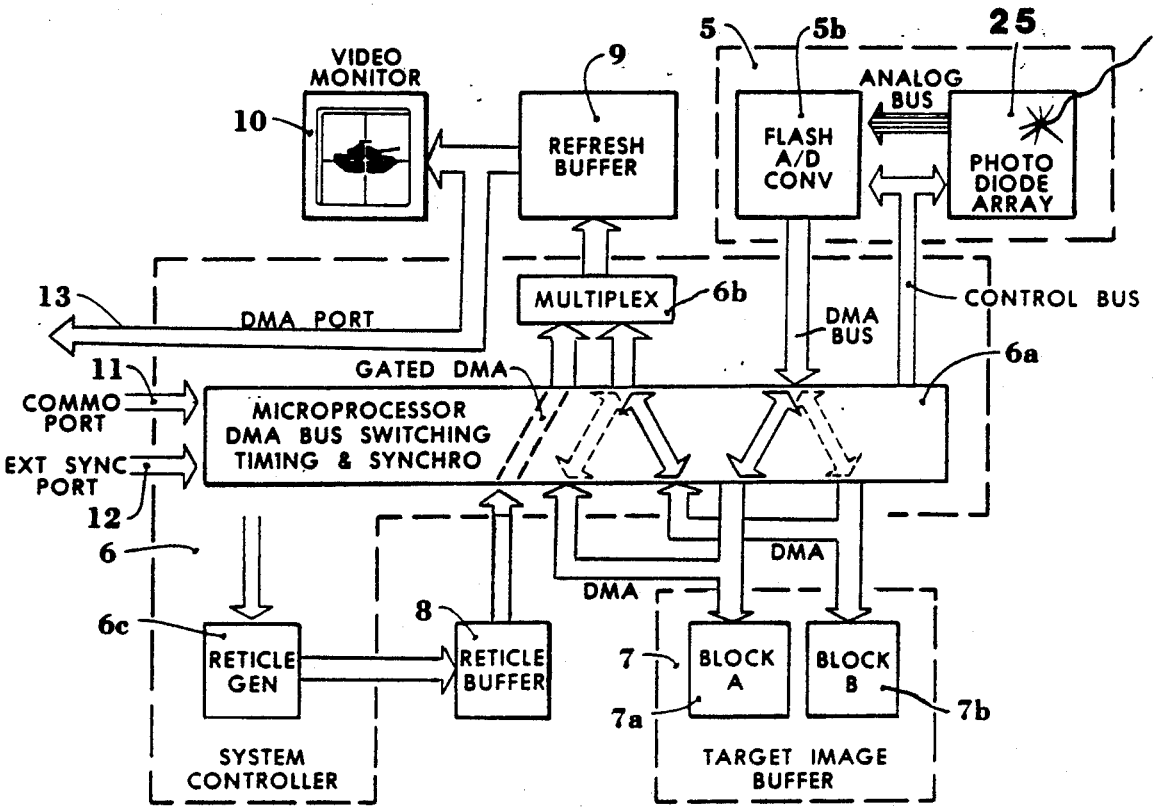
FIG 5
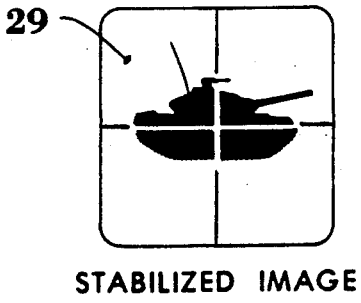
FIG 6-A

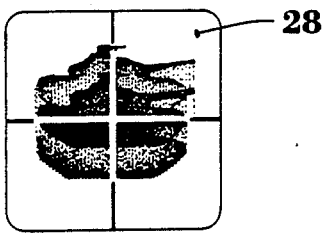
FIG 6-B
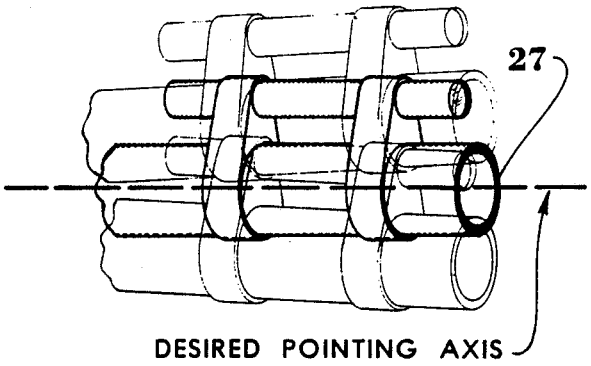
FIG 6-C

ELECTROOPTICAL MUZZLE SIGHT

RIGHTS OF THE GOVERNMENT

The invention described herein may be manufactured, used and licensed by or for the United States Government for Governmental purposes without payment to us of any royalty thereon.

BACKGROUND OF THE INVENTION

The present invention is related to direct aiming of the muzzle of a moving or stationary direct fire weapon. Through the use of modern electrooptical technology, the gunner is presented a stabilized image of the target along with a referencing reticle enabling the direct aiming of the muzzle with respect to the target.

Conventional techniques of weapon aiming dictate that to maximize gun system repeatability, the axis of the muzzle should be placed on the desired gun-to-target line. The muzzle axis is defined by the foremost length of the gun tube equal to four times the diameter of the gun tube. Current sighting and aiming systems in large caliber direct fire weapons such as tanks do not directly point the muzzle of the gun. These systems employ sighting and aiming techniques that point the axis of the breech end of the gun on the desired gun-to-target line. These modern systems employ optical sights such as telescopes and periscopes which are mounted either to the mantlet or the turret of the tank and are linked to the pointing axis of the gun breech by by mechanical, optical or servo-mechanical stabilization means. The orientation of the muzzle axis is derived by either system zeroing techniques or muzzle referencing techniques. In either case, there is no direct means of pointing the muzzle at the target during an engagement. The gunner must use an eyepiece which is mounted to the tank structure. The gunner must keep his eye aligned with the eyepiece in order to minimize parallax in the sighting system. Current systems offer a minimal solution to the eye alignment problem by providing a brow pad to stabilize the gunner's head.

In addition to the basic sighting system, superelevation of the gun tube is introduced to the system through fire control computers based on either the measured or estimated range to the target. This technique "softens" the connection between the sight alignment and the breech axis alignment in elevation. Systems with stabilization further "soften" the sight/gun connection due to separate stabilization of the sight and gun. The stabilization system maintains the gun's breech axis in a position that is coparallel to the pointing direction determined by the gunner while the tank is moving. No direct means is provided in stabilization systems to control the muzzle pointing direction.

Recent sighting systems also employ muzzle reference devices, either active or passive, mounted on the muzzle of the gun to measure the difference between the pointing direction of the muzzle and the pointing direction of the breech. As currently used, the systems provide data to adjust the relative position of the sight axis with respect to the breech axis in order to maintain system zero. These muzzle reference devices can be made to operate in either a continuous or intermittent mode depending on the specific system design. It should be pointed out that these systems do not directly reference the muzzle direction to the target. Controlling the breech direction in order to stabilize the muzzle motion on a moving tank would require servo systems capable of delivering two to four times the power Presently available in tank stabilization systems.

The most recent development in sighting systems is the Precision Aim Technique (PAT) which provides an appropriate firing time, causing the projectile to exit the muzzle of the gun when the muzzle is within a predetermined position window with respect to the breech. Essentially, this system causes repeated firings from a moving gun tube to occur when the muzzle is in the same position with respect to the breech. The PAT significantly enchaces shot to shot repeatability without adding any burden to the fire control and stabilization systems. Although the PAT system significantly reduces dispersion of shot about the center of impact for rounds fired from a moving gun tube, it does not directly adjust the center of impact and the aim point.

OBJECTS AND SUMMARY OF THE INVENTION

It is therefore a primary object of the invention is to allow laying the gun by directly pointing the muzzle, which is accomplished by physically mounting the optical sighting element of the system on the muzzle.

Another object of the invention to reduce the relative motion and displacement between the muzzle axis and the sight axis by attaching the optical sighting element to the muzzle using a rigid mechanical fixture.

A further object of the invention is eliminate parallax between the gunner's eye and the gun sight by providing a video display of the target/reticle image, thus the reticle image and target image will be on the same plane and have the same effective focal length.

A still further object of the invention is to eliminate the need for sight stabilization by synchronizing the camera framing with the PAT system and by mounting the optics of the gun sight to the muzzle.

Another object of the invention is to eliminate the gunner's need to estimate sight adjustments for lead and cant and also to eliminate the need to change the position of the gun relative to the sight by using digital outputs from the fire control computer as input to high-speed array processing firmware to modify the reticle pattern to account for superelevation, cant, jump and lead which allows the gunner to lay the cross hairs directly on the target.

A further object of the invention is to electronically change the magnification power of the sight by using state-of-the-art sensor arrays in the telescopic camera.

Another object of the invention is to reduce the gunner's eye strain and mental fatigue by stabilizing the sight picture thus eliminating the jitter caused by tank and gun tube motion using a digital processor and the appropriate buffers and interfaces.

A further object of the invention is to make available sight image digital data for other processing systems and for measurement or training purposes by using digital array processing techniques.

A still further object of the invention is to calibrate a conventional system continuously during use with the muzzle sight system by replacing the muzzle reference system on a state-of-the-art sight/fire control/stabilization system with the appropriate array processing techniques.

The most direct means of pointing the muzzle of a gun at a target is to mount the sight on the muzzle. This can be accomplished by using modern solid state digital video camera technology which allows the sight picture to be viewed by the gunner at some convenient location remote from the gun muzzle. By utilization of a large screen video monitoring system which displays a multiplexed picture of the target superimposed on the reticle, the gunner is no longer required to maintain a precise eye position with respect to the sight. Through the use of appropriate digital data processing techniques the reticle position on the screen is adjusted to compensate for superelevation, cant, jump and lead. These compensating quantities are provided by the fire control computer. The reticle is laid on target by moving the gun through the gunner's control.

To allow this system to be used on moving guns and targets, stabilization of the gun and synchronization of the camera are required. Gun stabilization is well known in the art and a detailed discussion is not necessary to an understanding of the present invention. Camera synchronization from a PAT or other similar system is required to frame the camera when the muzzle is in a predetermined position with respect to the breech. Digital processing hardware provides the necessary output to the monitor to allow continuous viewing of the sight image and minimizes jitter and flicker.

BRIEF DESCRIPTION OF THE DRAWINGS

FIG. 5 is a block diagram of the electronic logic of the electrooptical muzzle sight system shown in FIG. 1.

FIG. 6*a* is a depiction of the sight image with image stabilization.

FIG. 6*b* is a depiction of the sight image without image stabilization.

FIG. 6*c* is a depiction of a moving muzzle with an electrooptical muzzle sight attached.

DETAILED DESCRIPTION OF THE PREFERRED EMBODIMENTS

Figure 1:
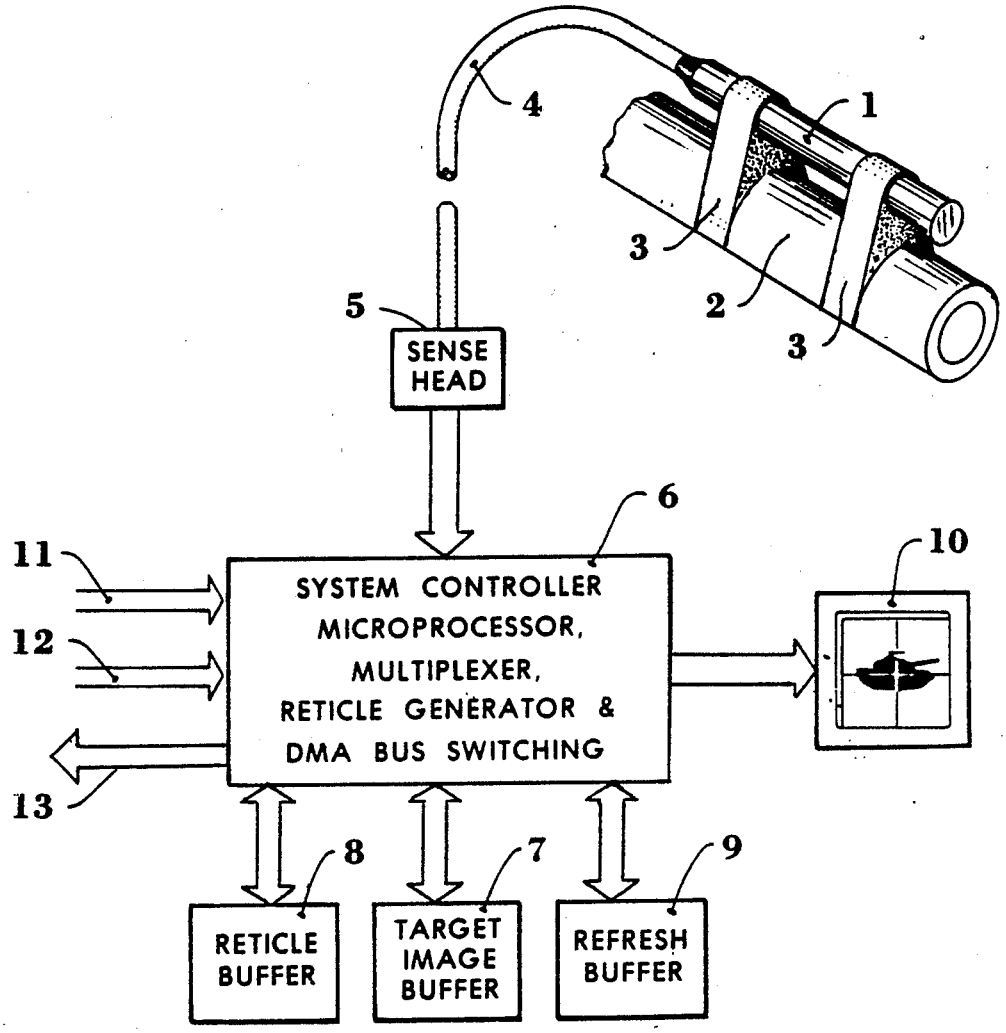
FIG. 1 is a diagram of an electrooptical muzzle sight system according to the teachings of the present invention.

Referring now to FIG. 1, an electrooptical muzzle sight system according to the present invention is shown diagramatically and consists of a fixed focal length telescope 1 mounted directly to the muzzle of gun tube 2 by means of rigid structural supports 3. Telescope 1 sends an image through a coherent fiber-optic transmission link 4 to electrooptical sensing head 5, which transforms the optical image into a digital voltage signal. The digital image data are transferred, via a direct-memory-access (DMA) bus, through system controller 6 to target image buffer 7. System controller 6 regulates the framing rate of sensing head 5, nominally 600 frames per second, and stores consecutive alternate image frames in two memory blocks in target image buffer 7. Controller 6 processes data from the tank system fire control computer (not shown) via communication port 11, generates the reticle image required to account for lead superelevation and cant, and stores the appropriate reticle image in recticle buffer 8.

When operating in the dynamic mode, a synchronization pulse emanating from the PAT system, which senses the instant that the gun tube is in its proper flexural condition, is provided at the synchronization port 12. Controller 6 multiplexes and transfers the most timely target and reticle images from their respective buffers 7 and 8 to refresh buffer 9 and provides a 60 frame-per-second composite image signal to video monitor 10 for viewing by the gunner. When desired, controller 6 also provides the composite image data to external systems via the DMA bus 13.

In the static mode, controller 6 maintains the framing rate of sensing head 5 at 60 frames per second and transfers the image data through the multiplexer to refresh buffer 9. The composite image is viewed on monitor 10 and is available at DMA port 13.

Figure 2:
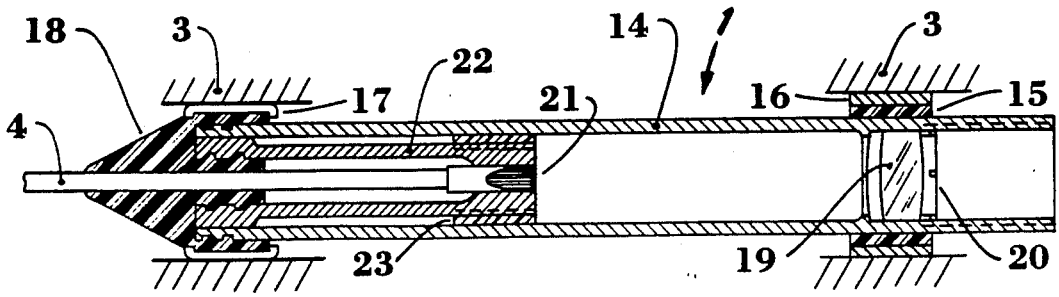
FIG. 2 is a cross section of a fixed focal length telescope used in the present invention.

The basic telescope assembly, illustrated in FIG. 2, consists of a housing tube 14, a spherical achromatic doublet 19, a threaded castellated ring 20, a fiber-optic bundle termination 21, and a temperature compensation tube 22. Fiber-optic bundle termination 21 is located precisely at the focal plane of doublet 19 and is fixed securely in the forward end of temperature compensation tube 22. The rear end of temperature compensation tube 22 is fastened to the rear end of housing tube 14 by a threaded interface. The relative lengths of the two tubes are determined by their coefficients of linear thermal expansion and the focal length of doublet 19. This structural geometry maintains the proper spacing between fiber-optic termination 21 and doublet 19 over a wide temperature range. Materials used successfully in one embodiment were steel for housing tube 14 and brass for compensation tube 22. Other combinations of dissimilar materials can also be used.

A damping bushing 23 is fastened to compensation tube 22 to minimize relative transverse motion between the forward end of compensation tube 22 and housing tube 14. Bushing 23 is constrained by housing tube 14 from moving in the transverse direction, but is allowed to slide longitudinally along the tube's inner surface. The bushing is fabricated of a viscoelastic-plastic material such a Nylon, Delrin, Teflon, PVC or other structural plastic.

Telescope assembly 1 is mounted in structural supports 3 with two mechanical filters. The purpose of these filters is to block the transmission of strain waves from supports 3 to housing tube 14 and also to minimize the severity of the accelerations imposed on the optical assembly. The forward filter consists of a visco-elastomeric bushing 15 which is bonded to both housing tube 14 and a steel mounting bushing 16. Mounting bushing 16 is then securely clamped in structural support 3 so that no transverse or longitudinal motion is allowed within structural support 3. The rear filter consists of a multipurpose visco-elastomeric molding 18 which is bonded to a steel centering bushing 17 and attached to fiber-optic bundle 4, housing tube 14 and thermal compensation tube 22 by an interference-fit thread to form both a weather-tight seal for the assembly and bending strain relief for fiber-optic bundle 4. Centering bushing 17 is constrained only in the transverse direction by structural support 3. This bushing is allowed to move longitudinally in the support so it may adjust to differential thermal elongation between structural supports 3 and optical assembly 1. Some degree of slack is required in the fiber-optic bundle between termination 21 and end molding 18 to allow for the difference in elongation between thermal compensation tube 22 and bundle 4.

Figure 3:
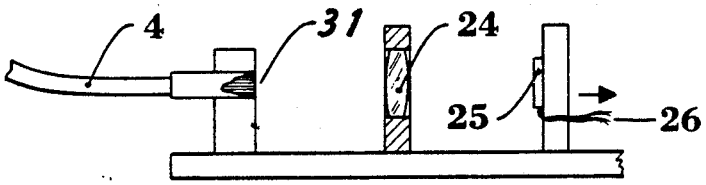
FIG. 3 is a side view of the spaced optics coupling between the fiber-optic bundle and charge-coupled photodiode area array used in the present invention.

FIG. 3 shows the spaced optics coupling between fiber-optic bundle 4 and charge-coupled photodiode area array 25. Fiber-optic termination 31 is located in the focal plane of spherical achromatic doublet 24. The receptor surface of photodiode array 25 is located in the conjugate focal plane of doublet 24. This spaced optics coupling system allows one to divide the input image, using a beam splitter, among two or more photodiode arrays, providing different magnifications of the target image or measuring various system parameters. The array video output and control functions are transmitted by electric cable 26.

Figure 4:
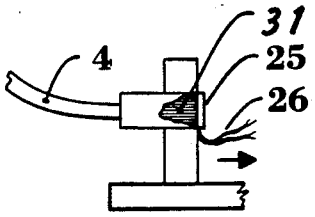
FIG. 4 is a side view of the close coupling used in severe environments.

FIG. 4 shows the close coupling for use in severe environments. In this technique, photodiode array 25 is bonded directly to fiber-optic bundle termination 31 using the appropriate optical-grade resin bonding agents. Dividing the input image with a beam splitter is not possible with close coupling, but different magnifications of the image can be provided by using nested photodiode arrays on the same silica substrate. Again, the video output is transmitted by cable 26.

FIG. 5 is a block diagram of the electronic logic of the system shown in FIG. 1. The optical image is sensed by solid state photodiode area array 25, which is part of sense head 5. As part of it's self-contained circuitry, photodiode array 25 has gain control circuits, sample-and-hold circuits and scanning circuits. Upon receipt of the appropriate control signals from system controller 6, the sample-and-hold circuit freezes the voltages in the whole array at the start of the frame scan for the duration of the frame scan. The data is transferred by way of a serial analog voltage video signal to flash analog/digital converter **5*b*. Converter 5*b* is controlled by system controller 6 and delivers a digital video via a DMA bus to transfer bus switching system 6*a*, internal to system controller 6. The target image is stored in one of two data blocks 7*a* and 7*b* in target image buffer 7. Consecutive alternate frames of video data are stored in each of the data blocks 7*a* and 7*b*. Simultaneously, a second switch is selecting the alternate data block for transferring the image data to multiplexer 6*b*. Data block 7*a* is in the write position and data block 7*b* is in the read position. This is to prevent the reading of partial images and storing them in refresh buffer 9**. The framing rate of this system is nominally 500 frames per second.

At the beginning of an engagement, the fire control computer sends the appropriate reticle settings based on range, cant, lead and projectile ballistics to communications port 11 of system controller 6. The data are fed to reticle generator **6*c*, which transfers the reticle image to reticle image buffer 8. Reticle image buffer 8 is connected to image multiplexer 6*b* by a gated DMA bus that is controlled by system controller 6**. Because the density of the reticle image data is approximately a factor of 512 smaller than the target image data, the effective framing rate is nominally 10,000 frames per second. This allows the utilization of a single data block buffer system for the reticle image.

When a synchronization pulse appears at the synchronization port 12 from the PAT system (or other gun tube condition sensing system), data in the available target image data block (in the illustrated case, block **7*b*) and the reticle image buffer 8 are transferred through multiplexer 6*b* to refresh buffer 9. The composite image is combined so that the reticle image is superimposed on the target image such that the reticle is in high contrast and reverse of the light values of the target image. That is, when the local target image is dark, the corresponding local reticle image is bright and vice-versa as shown in the composite image depiction in FIG. 1 and FIG. 5. The composite image is viewed by monitor 10 and is also provided to the fire control system via DMA bus 13** at a framing rate of 60 frames per second.

The system operation stated above is used to calibrate a conventional sighting system by applying zero correction to the reticle image at port 11. The resulting composite image at DMA port 13 is compared with the predicted sight setting calculated by the fire control computer. That is, the predicted lead and superelevation is compared with the achieved lead and superelevation as measured by the muzzle sight. This allows correction to be made to counteract the errors in the conventional sighting system due to differences in elevation between the target position and the gun position and the instantaneous misalignments between conventional sight and the gun pointing direction. Based on the framing rate of 500 frames per second and current processing speeds, the maximum image errors are 0.08 angular mils. This error is limited by the available state-of-the-art charge coupled device (CCD) photodiode detector arrays and array processing techniques.

When sighting is to be accomplished from a stationary gun, controller 6 switches both DMA switches **6*a* to the same data block 7*a* or 7*b* and synchronizes sense head 5 and multiplexer 6*b* at 60 frames per second. Thus sense head 5 is directly connected to the monitor system, and is synchronized with monitor 10**.

To illustrate the overall effect of the system operation, FIG. **6*a* shows a moving muzzle with a sight 27, FIG. 6*b* shows sight image 28 without image stabilization, and FIG. 6*a* shows sight image 29** with image stabilization.

A device according to the teachings of the present invention was built and tested on a U.S. Army M-1 tank. Measurements taken on the M-1 tank system indicated major frequency modes of 5 cycles per second and 17 to 23 cycles per second. Commercially available CCD photodiode arrays were obtained from several suppliers with framing rates of 500 frames per second which was more than sufficient to resolve frequency components of motion as high as 50 cycles per second. Existing DMA data transfer and processing techniques were more than sufficient to handle these higher framing rates for 512×512 pixel area arrays. The maximum errors developed in the timing of the system becomes plus or minus 2 milliseconds. Measured extremes of gun tube flexure showed that gun tube excursions of 0.8 angular mils at 5 cycles per second and 0.2 angular mils at 17 to 23 cycles per second were experienced. The maximum error E due to time delays in the sight system is:

$$E=0.8\sin(2\pi 5t)+0.2\sin(2\pi 23t)=0.11 \text{ angular mils}$$

where t is the maximum delay time in seconds. This maximum error occurs at severe bumps. The average excursion of the gun tube was 0.2 angular mils at 5 cycles per second and 0.05 angular mils at 17 to 23 cycles per second. Using the above relationship and substituting the average amplitudes yields the average maximum error due to timing errors of 0.03 angular mils.

Optically induced errors DE are a function of the array dimensions, focal length, array pixel count, and the angular aperture of the telescope:

$$DE=A/2C$$

where A=aperture in angular mils, C=the pixel count (no dimension) of 512, H=the maximum array dimension of 10 millimeters, and L=the focal length in millimeters. An aperture of 40 angular mils has a resolution of plus or minus 0.04 angular mils and requires a focal length of 250 millimeters. This establishes the focal length of the doublet. Other apertures and focal lengths can be readily chosen. This represents a resolution of 4 centimeters at 1 kilometer or 12 centimeters at 3 kilometers. For shorter ranges of 500 to 1500 meters, and aperture of 80 angular mils is more appropriate to allow for the sufficient lead of moving targets. This aperture yields a resolution of 0.08 angular mils and requires a focal length of 125 millimeters. This is equivalent to 12 centimeters at 1.5 kilometers.

The errors induced by the structural coupling between the gun tube and the telescope are governed by the stiffness of the mechanical filters and the focal length of the telescope. The telescope tube is steel with a linear thermal expansion coefficient of $0.125\times10E^{-4}$ per degree Celsius. The compensation tube is brass with a linear thermal expansion coefficient of $0.218\times10E^{-4}$ per degree Celsius. The relationship of the telescope length LT is derived as follows:

$$LT/LC=1.733 \text{ and } LT=LC+FL$$

therefore, $$LT=2.36FL$$

where LT=the length of the telescope in millimeters, LC=the length of the thermal compensation tube in millimeters, and FL=the focal length of the telescope in millimeters.

The maximum displacement d of the telescope with respect to the muzzle is a function of the filter stiffness and the maximum acceleration impressed on the gun tube. The maximum angular displacement is twice the ratio of this displacement to the telescope length.

$$d=G/(2\pi f)^2 \text{ and } Ed=2000000d/TL$$

where Ed=the maximum error due to mechanical displacement in angular mils, G=the maximum acceleration in meters per second squared, d=the relative displacement in meters, and f=the mechanical filter cutoff frequency in cycles per second. Based on results of previously designed and tested mechanical filters, filter cutoff frequencies of 1000 cycles per second are readily obtainable. Data from M-1 road tests show that maximum accelerations of 25 to 50 meters per second squared with an average maximum acceleration of 6 meters per second squared were experienced. This translates to a maximum error of 0.0045 angular mils and an average maximum error of 0.0005 angular mils for the 250 mm focal length telescope. A 125 millimeter focal length system will have twice the error. The cumulative errors for the 250 millimeter telescope system will be 0.145 angular mils maximum for severe bump conditions and 0.080 angular mils for maximum for average conditions.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. An electrooptical sighting system which provides a sight picture of a target in video display form comprising:
   - an electrooptical telescope rigidly fixed to the muzzle end of a gun tube;
   - a fiber-optic transmission link;
   - means for transforming the optical image transmitted from said telescope via said fiber-optic link into a digital voltage signal;
   - a system controller for processing said digital voltage signal, said controller providing an output to a video monitor allowing continuous viewing of said target regardless of framing rate.

2. The device of claim 1 further comprising a means for the multiple coupling of the optics to electronics thereby providing automatic magnification of the picture.

3. The device of claim 1 wherein said system controller comprises:
   - a microprocessor controlled switching, timing and synchronization DMA bus;
   - means for storing consecutive alternate frames of target image video data;
   - means for receiving data on range, cant, lead and projectile ballistics;
   - means for receiving a synchronization signal to synchronize the sight framing to the motion of the gun tube thereby minimizing sight picture jitter;
   - means for generating a reticle image based on range, cant, lead and projectile ballistics;
   - means for storing said reticle image;
   - means for combining said target image and said reticle image such that said reticle image is superimposed on said target image such that said reticle image is in high contrast and reverse of said target image;
   - means for storing said combined target-reticle image;
   - means for providing said combined target-reticle image to external systems.

4. The device of claim 2 wherein said means for the multiple coupling of the optics to electronics is accomplished by beam splitters.

5. The device of claim 2 wherein said means for the multiple coupling of the optics to electronics is accomplished by nested photodiode arrays.

6. The device of claim 2 wherein said means for the multiple coupling of the optics to electronics is accomplished by divided coherent fiber optic bundles.

7. The device of claim 3 wherein said means for storing consecutive alternate frames of target image video data is a target image buffer.

8. The device of claim 3 wherein said means for receiving data on range, cant, lead and projectile ballistics is a communications port connected between a fire control computer and said microprocessor controlled switching, timing and synchronization DMA bus.

9. The device of claim 3 wherein said means for receiving a synchronization signal to synchronize the sight framing to the motion of the gun tube is a synchronization port connected between a gun tube condition sensing system and said microprocessor controlled switching, timing and synchronization DMA bus.

10. The device of claim 3 wherein said means for storing said reticle image is a reticle buffer.

11. The device of claim 3 wherein said means for combining said target image and said reticle image is a multiplexer.

12. The device of claim 3 wherein said means for storing said combined target-reticle image is a refresh buffer.

* * * * *